US005743779A

United States Patent [19]

Nielsen

[11] Patent Number: 5,743,779

[45] Date of Patent: Apr. 28, 1998

[54] TOY SHIP

[75] Inventor: Per Steen Nielsen, Hvidovre, Denmark

[73] Assignee: INTERLEGO AG, Baar, Switzerland

[21] Appl. No.: 714,859

[22] Filed: Sep. 17, 1996

[51] Int. Cl.[6] ..... A63H 33/08; A63H 23/02

[52] U.S. Cl. ..... 446/93; 446/128; 446/160

[58] Field of Search ..... 446/93, 94, 128, 446/160, 163; D21/108

[56] References Cited

U.S. PATENT DOCUMENTS

| | | | |
|---|---|---|---|
| 4,184,285 | 1/1980 | Arnau Pibet | 446/93 |
| 4,349,984 | 9/1982 | Goldfarb et al. | 446/93 |
| 5,474,483 | 12/1995 | Sun | 446/128 X |

FOREIGN PATENT DOCUMENTS

| | | | |
|---|---|---|---|
| 1371282 | 10/1974 | United Kingdom | 446/160 |

*Primary Examiner*—Mickey Yu

*Attorney, Agent, or Firm*—Kane,Dalsimer,Sullivan, Kurucz, Levy, Eisele and Richard, LLP

[57] ABSTRACT

The invention concerns a toy ship having a hull part (1) which is blow moulded as a closed unit, and an upper part (2) which is injection moulded, the two parts being assembled to form the toy ship. The novelty of the toy ship is that at least one area of the upper part (2) is provided with coupling studs for coupling with other toy building elements (3), that this area is located between the outer, peripheral edge of the upper part (2) and the joint between the hull part (1) and the upper part (2), and that the outer, peripheral edge of the upper part (2) is cantilevered at least around the area provided with coupling studs.

5 Claims, 1 Drawing Sheet

TOY SHIP

BACKGROUND OF THE INVENTION

The invention concerns a toy ship comprising a hull part which is blow moulded as a closed unit, and an upper part which is injection moulded, said two parts being assembled to form the toy ship.

For many years, toy ships of plastics have been made by gluing an injection moulded upper part to an injection moulded hull part to thereby obtain a water-tight and air-filled hull having a good buoyancy. The injection moulding technique makes it possible to provide fine details on the upper part as well as the lower part, and this technique is therefore widely used in the making of life-like toy elements.

Gluing between the upper part and the hull part is an exacting operation if a successful result is to be achieved, and it is moreover frequently found that if the toy ship cracks and becomes leaky, this frequently takes place in the glue joint.

To overcome this problem, it has been proposed to use the blow moulding technique in the making of toy ships, whereby an entire ship may be made as a closed unit. This technique comprises inflating a "plastics balloon" in a closed mould until the balloon fills the entire mould, and then the blow hole is closed. This results in a completely closed element without any glue joints.

The drawback of the blow moulding technique is that it is not possible to make fine details and sharp edges. If the toy ship is to be completely life-like, this problem has to be solved.

The problem is solved in SE B 446 154 by using a blow moulded hull part and an injection moulded upper part, said two parts being coupled together by means of holes/cuts at each end of the ship. This provides a toy ship which has a completely closed hull part and an upper part which exhibits fine details.

Coupling between the two parts (the hull part and the upper part) takes place at each end of the ship, which means that if e.g. for some reason the hull part has become wry longitudinally of the ship, the upper part will conform to this wryness and be twisted askew in a corresponding manner.

Of course, this is not very important if the toy ship just consists of the two parts, but if the upper part of the toy ship is provided with coupling means for the coupling of further elements, it may be critical if this part has been twisted askew.

Firstly, it may be mean that the further elements cannot be coupled, because the twisted position of the coupling means does not allow coupling, and secondly it involves the risk that already coupled elements jump off because of a wry connection.

In any event, there will be a disuniform coupling force between the coupling means of the wry upper part and the coupling means of the further elements.

SUMMARY OF THE INVENTION

Accordingly, the object of the present invention is to provide a toy ship of the type mentioned in the opening paragraph which does not suffer from the above-mentioned drawbacks.

This is achieved by arranging the toy ship such that at least one area of the upper part is provided with coupling means for coupling with other toy building elements, that this area is located between the outer, peripheral edge of the upper part and the joint between the hull part and the upper part, and that the outer, peripheral edge of the upper part is cantilevered at least around the area provided with coupling studs.

This ensures that none of the areas of the upper part provided with coupling means is fixed between two coupling points, and that these areas having coupling means will therefore not be subjected to any forced distortion caused by a wryness of the hull part.

The coupling means are preferably formed by coupling studs arranged in a regular pattern and protruding from the surface of the upper part. The upper part will hereby resemble a so-called building plate having firm modular measures between the coupling studs on which other types of generally known toy building elements may be coupled.

In a preferred embodiment of the toy ship of the invention, the upper part has a central, downwardly extending part which may be coupled with a complementary cut which is provided in the hull part and which may be shaped as a through hole, so that the hull part constitutes a closed, air-filled ring. The downwardly extending part of the upper part may be open to provide access to the water through the hole extending through the hull part. Alternatively, the downwardly extending part may be closed and represent e.g. a hold on the toy ship.

The downwardly extending part of the upper part and the complementary cut of the hull part have a non-circular cross-section in a preferred embodiment to ensure that the two parts cannot rotate with respect to each other. This additionally ensures that the outer edge of the upper part will not engage the hull part, which might cause distortion of the upper part at worst.

BRIEF DESCRIPTION OF THE DRAWINGS

The invention will now be explained more fully with reference to the drawing, in which.

DETAILED DESCRIPTION OF THE DRAWINGS

Figure 1:
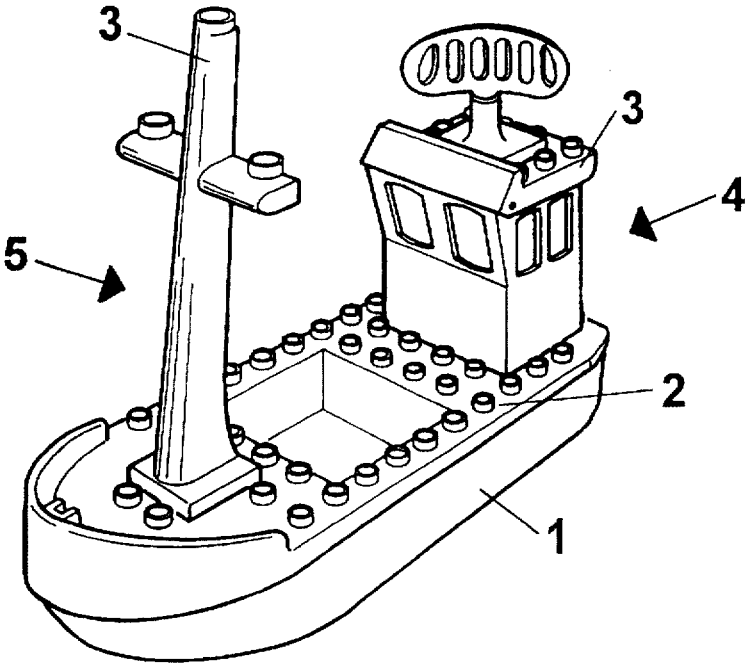
FIG. 1 shows a toy ship of the invention in a preferred embodiment and with further toy building elements coupled on the upper part of the ship.

FIG. 1 shows a preferred embodiment of the toy ship of the invention. The toy ship consists of a hull part 1 of blow moulded plastics and an upper part 2 of injection moulded plastics. It is shown by way of example in FIG. 1 how various toy building elements 3 may be coupled on the upper part e.g. to form a deckhouse 4 or a mast 5.

Figure 2:
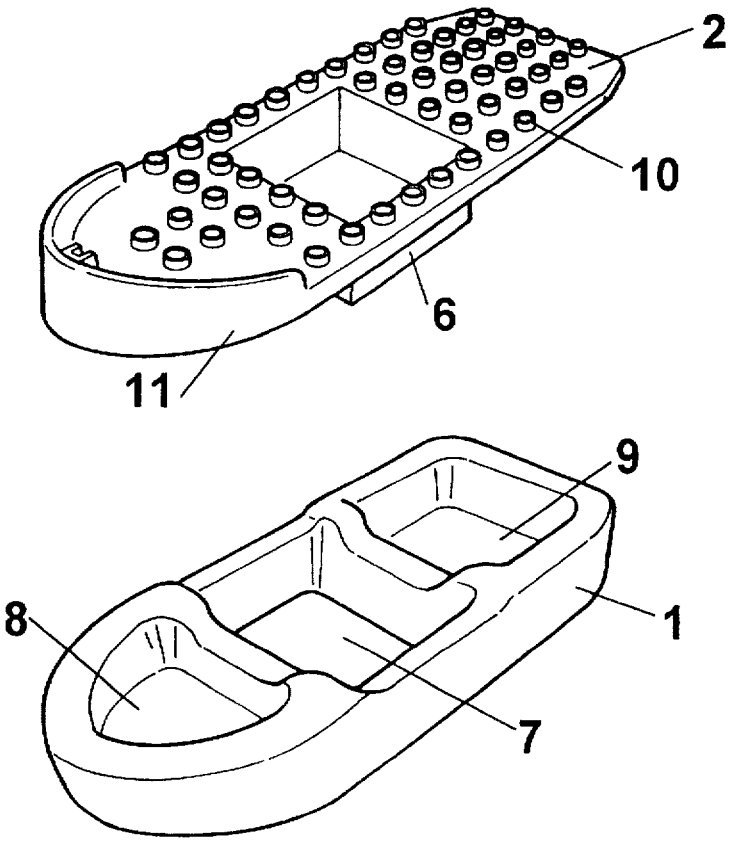
FIG. 2 shows the upper part and the hull part of the toy ship shown in FIG. 1 in a disassembled state.

The hull part 1 and the upper part 2 of the toy ship is assembled by means of a coupling mechanism which is shown in its entirety in FIG. 2, which shows the hull part 1 and the upper part 2 in a disassembled state.

As appears from this figure, the coupling mechanism consists of a part 6 extending downwards from the upper part 2 and a through hole 7 in the hull part. In the embodiment shown, the downwardly extending part 6 is shaped as a four-sided recess in the surface of the upper part 2, and the part 6 and the through hole 7 are adapted to each other in such a manner that there is a relatively great coupling force between the hull part 1 and the upper part 2 when the ship is assembled.

As mentioned, the hull part 1 consists of blow moulded plastics which is formed to the shape shown in FIG. 2. As already mentioned, the hole 7 constitutes a coupling part for coupling the hull part 1 and the upper part 2 together. In addition, the hull part 1 is formed with recesses 8 and 9 whose purpose is to stabilize the ship when it is placed in water. The amount of air and its location inside the closed hull part 1 are decisive for the stability of the toy ship and its height over the surface of the water.

In contrast to the hull part 1, the upper part 2 consists of injection moulded plastics, which makes it possible to form fine details on the upper part 2. The upper part 2 is provided with coupling studs 10 on the upper side, so that other toy building elements 3 may be coupled on the upper part 2 e.g. to build a deckhouse 4 and a mast 5, as shown in FIG. 1.

The upper part 2 moreover has an outer, peripheral edge 11 which extends along the outer edge of the upper part 2. The outer part of the edge 11 hangs down over the upper edge of the hull part 1 when the toy ship is assembled, but does not touch it.

The coupling studs 10 are positioned in areas which are located between the outer, peripheral edge 11 and the coupling means 6 and 7 of the hull part 1 and the upper part 2. This is essential to the invention, as these areas are just secured with respect to the hull part 1 at one side, viz. by the coupling means 6 and 7 between the hull part 1 and the upper part 2. The outer, peripheral edge 11, on the other hand, is not secured with respect to the hull part 1, and, accordingly, the areas having coupling studs 10 will not be affected by any wryness in the hull part 1.

It is ensured hereby that the coupling force between the coupling studs 10 of the upper part 2 is not affected by any wryness in the hull part 1.

In the embodiment shown, the coupling means 6 and 7 have a rectangular cross-section, as the recess in the upper part 2 conforms to the modular measure of the coupling studs 10. As a result, toy building elements 3 fitting the shown coupling studs 10 also fit in the recess.

The coupling means 6 and 7 may have a cross-section other than rectangular, it being preferred that they are not circular. The use of circular coupling means 6 and 7 involves the risk that the upper part 2 may be turned with respect to the hull part 1, whereby the otherwise cantilevered, outer, peripheral edge may be locked against the upper edge of the hull part 1 and here be affected by a possible wryness in the hull part 1, so that the object of the invention is not achieved.

The downwardly extending part 6 of the upper part 2 is shaped as a blinded recess in the surface. The recess might conceivably be made open to provide access to the water from the surface of the upper part 2 through the hull part 1.

Further, the through hole 7 of the hull part 1 need not extend therethrough, but may merely be a recess which corresponds to the downwardly extending part 6 of the upper part 2.

A number of other modifications and changes may be made within the scope of the invention without departing from the idea of the invention.

I claim:

1. A toy ship comprising a hull part (1) which is blow moulded as a closed unit, and an upper part (2) having an outer peripheral edge, said upper part being injection moulded, said hull part (1) and upper part (2) being assembled at least one joint to form the toy ship, wherein at least one area of the upper part (2) is provided with a plurality of coupling means for coupling with other toy building elements (3), said at least one area being located between a part of the outer, peripheral edge of the upper part (2) and the at least one joint between the hull part (1) and the upper part (2), such that the outer, peripheral edge of the upper part (2) is cantilevered at least in the area provided with coupling means.

2. A toy ship according to claim 1, wherein the coupling means are formed by coupling studs (10) arranged side by side in a regular pattern and protruding from the surface of the upper part (2).

3. A toy ship according to claim 1, wherein the upper part (2) has at least one central downwardly extending part (6) which may be coupled with a complementary recess (7) provided in the hull part (1).

4. A toy ship according to claim 3, wherein the recess (7) of the hull part (1) is formed by a through hole so that the hull part (1) forms a closed, air-filled ring surrounding said recess.

5. A toy ship according to claim 3, wherein the downwardly extending part (6) of the upper part (2) and the complementary recess (7) of the hull part (2) is non-circular in cross-section.

* * * * *